United States Patent [19]

Favot

[11] Patent Number: 4,606,388

[45] Date of Patent: Aug. 19, 1986

[54] PROCESS FOR DENSIFYING LOW DENSITY WOODS

[76] Inventor: Peter Favot, 5 Milne Crescent, Kanata, Ontario, Canada

[21] Appl. No.: 717,145

[22] Filed: Mar. 28, 1985

[51] Int. Cl.[4] ..... B27M 1/02

[52] U.S. Cl. ..... 144/361; 144/380; 144/362; 427/297

[58] Field of Search ..... 144/361, 362, 364, 380; 427/297, 325, 351, 369, 370, 440

[56] References Cited

U.S. PATENT DOCUMENTS

| | | | |
|---|---|---|---|
| 2,101,542 | 12/1937 | Hartzell | 144/309 |
| 2,343,016 | 2/1944 | Loughborough | 144/380 |
| 3,282,313 | 11/1966 | Schuerch | 144/361 |
| 3,642,042 | 2/1972 | Davidson et al. | 144/327 |
| 3,646,687 | 3/1972 | Berzin et al. | 427/13.8 |
| 3,894,569 | 7/1975 | Huttunen | 144/380 |
| 4,473,099 | 9/1984 | Koike et al. | 144/362 |

*Primary Examiner*—Francis S. Husar
*Assistant Examiner*—John M. Griffin

[57] ABSTRACT

Low quality, low density woods are densified to form wood products having the characteristics of high quality natural hardwoods. A green solid wood member having a high moisture content is impregnated with anhydrous ammonia to plasticize the wood into a sponge-like form saturated with water and ammonia. This plasticized wood member is placed between press plates of a cyclic press and, while maintaining the temperature of the wood below 100° C., it is subjected to a plurality of low pressure compression cycles each of about ½ to 1 minute duration with the wood being compressed to a predetermined thickness of up to 50% less than its original thickness. It is held at the reduced thickness for a short time and released during each cycle, whereby water and ammonia are squeezed out of the wood down to a moisture content of less than about 30%. The damp wood member of reduced thickness thus obtained is then dried to obtain a kiln dried, densified solid wood product. This method may be used to densify wood planks, pre-glued laminates and thin veneers. For veneers, a simpler pressing system and higher temperatures may be used.

19 Claims, 2 Drawing Figures

PROCESS FOR DENSIFYING LOW DENSITY WOODS

BACKGROUND OF THE INVENTION

This invention relates to an improved process for producing a densified solid wood product.

It has been known for many years that wood can be plasticized for forming by treatment with anhydrous ammonia. For instance, U.S. Pat. No. 3,282,313 teaches that wood plasticized with anhydrous ammonia can be compressed by cold compression in a press to convert the wood to a much harder, mar-resistant, glossy-surfaced product. While such processes have been known for many years, practical and inexpensive commercial systems have not been developed.

It is, therefor, the object of the present invention to provide an improved process whereby low quality, low density woods can be inexpensively densified or compressed to form wood products having the characteristics of high quality natural hardwoods.

SUMMARY OF THE INVENTION

In the process of the present invention, a low quality, low density solid wood of high moisture content is firstly impregnated with anhydrous ammonia whereby the wood member is plasticized to a sponge-like form saturated with water and ammonia. This plasticized wood member is placed between the perforated press plates of a cyclic press and, while maintaining the temperature of the plasticized wood member below 100° C., it is subjected to a plurality of compression cycles with the entire wood member being substantially simultaneously compressed to a predetermined thickness, held at that thickness for a short period of time and released during each cycle. In this manner, water and ammonia are squeezed out of the wood member through the faces thereof down to a moisture content of less than 30% to obtain a damp wood member of predetermined reduced thickness. This damp compressed wood member is then dried to obtain a dry, permanently densified solid wood product having the characteristics of high quality natural hardwood.

DESCRIPTION OF THE PREFERRED EMBODIMENTS

The wood which is used in the present invention is a low quality, low density wood preferably of the hardwood type, typically having a density of about 300–400 $Kg/m^3$. Coniferous woods of high gum content, e.g. pine, spruce, balsam, etc., are generally not suitable. Among particularly useful woods for the process of this invention, there can be mentioned poplar, alder, cottonwood, rubber tree and soft maple. With some woods, such as poplar, it is preferable to use sapwood only, substantially free of any heartwood.

It is particularly advantageous with the process of this invention to utilize freshly cut, green wood of high moisture content. Such wood will typically have a moisture of at least 50% and usually at least 80%.

For densifying in accordance with this invention, the wood can be cut into planks having thicknesses of up to 2 inches or it can be in a form of a thin veneer, e.g. having a thickness of about ⅛ inch, or it can be in the form of a pre-glued wood laminate.

Ammonia Treatment

Anhydrous ammonia is a strong, hydrogen bonding, low molecular weight solvent which penetrates not only into amorphous areas of the fiber cell wall but also into the lignin binding material of a wood member. Some of the hydrogen bonds responsible for the rigidity of wood are broken by the ammonia. This results in a softening or plasticizing of the fiber structure so that the wood assumes a sponge-like characteristic and can be compressed at moderate pressure. As the ammonia is removed from the wood, hydrogen bonds are again formed between the polymer chains, although not necessarily at the same locations on the polymer chains or between the same microfibrils, resulting in the wood member once again becoming rigid.

It is necessary that an intimate contact be achieved between the ammonia and the fiber structure. To achieve this, the wood member being impregnated with ammonia generally contains about 20–30% moisture, although moisture levels both above and below this range may be used. However, if the moisture content is too low, a proper plasticization will not be achieved.

For treatment with ammonia, the solid wood members are placed in a vacuum chamber and a negative pressure is applied. Typically a negative pressure of about one atmosphere (30" Hg.) may be used for about 15 to 20 minutes. Ammonia gas may be added to the chamber while still under vacuum. At the end of the vacuum stage, ammonia gas is pumped into the chamber, conveniently at room temperature, and at a pressure of preferably about 100 to 150 psi. This ammonia pressure is maintained for usually about 2 to 8 hours depending on the thickness of the wood, the species, etc. At the end of the ammonia pressure stage, the chamber is vented and evacuated at a negative pressure for about 15 minutes.

This ammonia treatment stage may also conveniently be used for dying the wood. Thus, at the beginning of the ammonia treatment, the wood may be first impregnated with a dye which uniformly dyes the wood member throughout its thickness. Dying in this manner has the advantage that when the densified wood members are cut or planed, the newly exposed surfaces are of uniform color.

Cyclic Pressing

The invention is illustrated by the attached drawings in which.

Figure 1:
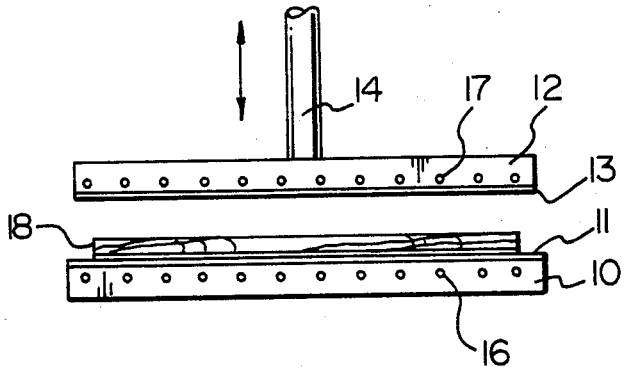
FIG. 1 is a side elevation of a cyclic press.
Figure 2:
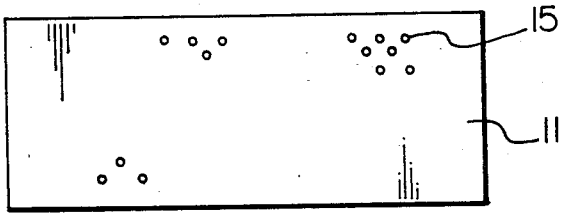
FIG. 2 is a top plan view of one perforated plate.

The cyclic press includes a bottom press member 10, the top face of which is in the form of a perforated plate 11 having perforations 15. Beneath perforated plate 11 is a drainage grid connected to drainage outlets 16.

Above press member 10 is top press member 12 which is connected to hydraulic cylinder 14 for vertical cyclic movement. Press member 12 has a perforated bottom face plate 13 and above this face plate is a drainage grid connected to drainage outlets 17.

The wood members removed from the vacuum chamber are thoroughly plasticized and are in a sponge-like form saturated with water and ammonia. The plasticized wood members 18 are then placed between the press plates 10, 12 of a cyclic press and, while maintaining the temperature of the plasticized wood members below 100° C., they are subjected to a plurality of compression cycles with the wood members being compressed to a predetermined thickness, held at that thickness for a short period of time and released during each cycle. In this manner, water and ammonia are squeezed out of the wood members down to a moisture content of less than about 30% to obtain a damp wood member of predetermined reduced thickness. In a typical procedure for densifying planks having a thickness of 1 to 2 inches, the cyclic pressing is conducted at a press pressure of about 175 psi for a total of about 2–5 minutes. Each press cycle has a duration of about ½ to 1 minute. In this manner, the thickness of the wood can be reduced by an amount of up to 50% and the density increased from about 300–400 $Kg/m^3$ to as much as 1000 $Kg/m^3$.

It is to be understood that the above pressing times and pressures can be varied quite widely depending on the species and thickness of the wood member being densified and the densification required. For instance, a wood member plasticized with ammonia will undergo a densification of about 5% without any external compressing.

Both the top and bottom press plates are preferably perforated so that during the cyclic pressing, the water and ammonia can emerge not only from the side edges of the wood member but also from the top and bottom faces. During this stage, the water and ammonia are squeezed out of the wood much in the manner of squeezing a sponge. Large quantities of water and ammonia (both dissolved and gaseous) can be removed from the wood member very inexpensively and in a very short period of time using this simple mechanical squeezing technique. For instance, it can reduce the moisture content from as high as 80–90% down to as low as 20–30%. This makes it practical according to this invention to start work with a freshly cut, green wood member containing 80–90% moisture.

This is an important economic advantage of the present invention. It is a very expensive procedure to predry wood down to the optimum moisture range of 20–30% for impregnating with ammonia. By starting with green wood of very high moisture, impregnating this with ammonia and squeezing ammonia and water out of this quickly at quite low pressures and temperatures, great savings are realized.

When applying cyclic pressing to a thick wood member, it is preferable to use temperatures below 100° C., thereby avoiding formation of steam and resultant damage to the wood. It has also been found to be particularly advantageous to subject the wood member to high frequency vibration during cyclic pressing, since this helps the removal of water and ammonia from the wood.

At the end of the pressing stage, the wood member remains in a compressed state of reduced thickness while still containing a considerable quantity of moisture.

The above cyclic pressing technique is particularly useful for densifying thick wood members, such as planks and pre-glued laminates. However, when densifying thin veneers, e.g. ⅛ inch thick, steam formation is not a serious problem and so they can be densified by simpler pressing methods and at higher temperatures. For example, thin veneers can be densified at temperatures as high as 200° C. and the densification can be carried out between rollers.

By using several pairs of rollers in series, the complete densification and final drying of thin veneers can be carried out in one stage. The first pair of rollers squeeze out water and ammonia, intermediate rollers fix the veneer at a predetermined reduced thickness and final heated rollers fully dry the veneer.

Drying

The damp compressed wood member from the cyclic pressing stage is subjected to kiln drying at an elevated temperature, preferably below 100° C., whereby the moisture content is reduced down to approximately 8%. During drying, it is not necessary to continue pressing the wood member but it is necessary to firmly retain it between support plates to prevent any warping during the drying stage.

The product emerging from this drying stage is a permanently densified, high quality hardwood having substantially the same length and width as the original stock, but having a substantially reduced thickness. The densification is consistent throughout the thickness of the wood member and it can be sanded, planed, routered, drilled, nailed, screwed and sawn similar to other hardwoods. The product can be stained, polished and finished at least as well as regular hardwoods and has a very dense surface with a minimum of texture and porosity, requiring very little preparation prior to finishing.

Certain preferred embodiments of the present invention are illustrated by the following examples:

EXAMPLE 1

Roughly sawn planks of 1 and 2 inch thicknesses were cut from green poplar and alder. The test planks had a width of 4 inches, a length of 1½–2 feet and a moisture content of 80%.

The samples thus prepared were placed in a gas retort with spacers between the planks. The chamber was evacuated with a negative pressure of approximately one atmosphere for 15 to 20 minutes, with ammonia gas being introduced into the chamber during that time. At the end of the 15 to 20 minutes, the vacuum was discontinued and ammonia gas was pumped into the chamber at room temperature and a pressure of approximately 100–150 psi. This pressure was maintained for approximately 6 hours. Following this 6 hour period, the chamber was vented and evacuated at a negative pressure (vacuum) of one atmosphere for 15 minutes. Thereafter, the pressure was released, the door opened and overhead venting continued.

The plasticized wood samples thus obtained were placed in a cyclic press between perforated plates. While maintaining an elevated temperature below 100° C., a pressure of about 175 psi was applied with a cyclic pressing procedure consisting of 1 minute press cycles for a total period of 5 minutes. During each down cycle the perforated pressure plates reduced the thickness of the wood member by about 50%, were held in this position for approximately 45 seconds and then released. In this manner, the level of water in the wood was reduced from 80% down to about 20–30%, at the same time driving out dissolved ammonia, gaseous ammonia and water, thereby reducing the plasticization effect on the wood fibers. At the end of the cyclic pressing stage, wood samples were obtained having their thickness reduced to about 50% of their original thickness.

These samples having a moisture content of about 20–30% were placed in a kiln and dried while being firmly restrained between perforated plates. In this manner they were dried down to a moisture content of about 8%.

The high quality hardwood boards thus obtained were subjected to a series of qualitative and quantitative tests and these were compared with the characteristics of regular oak, maple and birch boards. The results are shown in Table I below:

TABLE I

| WOOD SPECIES | MOISTURE CONTENT (percent) Green | Air Dry | SPECIFIC GRAVITY Air Dry | Oven Dry | DENSITY OVEN DRY kg/m³ | lb/cf | WATER ABSORPTION (percent) 2 hr. soak | 24 hr. soak | SWELLING (percent) (oven dry - 24 hr. soak) Radial | Tangential | Volumetric | ABRASION TEST* (Loss in Thickness) ($10^{-3}$ inch) |
|---|---|---|---|---|---|---|---|---|---|---|---|---|
| Densified Poplar | — | 16 | 1.17 | 0.98 | 980 | 61.3 | 11.0 | 29.0 | 29.1 | 0.6 | 31.5 | 5.0 |
| Densified Alder | — | 11 | 1.21 | 0.99 | 990 | 61.9 | 9.5 | 30.4 | 30.1 | 0.5 | 28.2 | 10.0 |
| Oak | 53 | 15 | 0.68 | 0.77 | 770 | 48.1 | 17.5 | 28.2 | 4.3 | 4.4 | 9.6 | 14.6 |
| Maple | 59 | 14 | 0.66 | 0.70 | 700 | 43.8 | — | 35.1 | 6.4 | 2.3 | 10.9 | 6.6 |
| Birch | 63 | 13 | 0.62 | 0.66 | 660 | 41.3 | 25.7 | 33.0 | 6.8 | 2.6 | 9.4 | 12.0 |

*ASTM method D2394 (1000 revolutions)

TABLE Ia

| WOOD SPECIES | HARDNESS (Radial Surface) (side) (Dry) | STATIC BENDING MOR (MPa) (Modulus of Rupture) (dry) | MOE (MPa) (Modulus of Elasticity) (dry) | COMPRESSION PARALLEL TO GRAIN (MPa) (ultimate stress) (dry) | COMPRESSION PERPENDICULAR TO GRAIN (MPa) (proportional limit stress) (dry) | FLAME SPREAD INDEX (ASTM E-162) | NITROGEN CONTENT (percent, total) |
|---|---|---|---|---|---|---|---|
| Densified Poplar | 4518 | 74.4 | 12257 | 47.0 | 12.4 | 50–60 | 1.30 (0.02 untreated) |
| Densified Alder | 9909 | 111.9 | 12188 | 57.5 | 15.0 | 80–95 | 1.13 (0.20 untreated) |
| Oak | 5525 | 98.7 | 11900 | 49.8 | 8.89 | 91–99 | 0.10 to 0.20 |
| Maple | 6596 | 115.0 | 14100 | 56.4 | 9.72 | 93–97 | 0.10 to 0.20 |
| Birch | 5525 | 106.0 | 14100 | 52.1 | 7.24 | 86–106 | 0.10 to 0.20 |

TABLE 1b

| WOOD SPECIES | GLUEABILITY* (wood failure - %) Resorcinol Phenol Formaldehyde | Polyvinyl Acetate | FUNGAL RESISTANCE weight loss (percent) (ASTM D-2017) Gloeophyllum Trabeum |
|---|---|---|---|
| Densified Poplar | 75 | 100 | 40 ± 7 (Control Poplar-65%) |
| Densified Alder | 100 | 100 | 38 ± 10 (Control Red Pine-66%) |
| Oak | | | 0–16 |
| Birch | | | 45 + |

*100% wood failure signifies an excellent bond

The poplar woodstock produced a walnut-looking hardwood, while the alder produced an ebony-looking hardwood. The densified woods were approximately ⅓ denser than the 3 natural hardwoods, with the densified poplar having an hardness near equal to the high quality natural hardwoods, while the densified alder had an hardness twice that of the high quality natural hardwoods. The natural hardwoods have a class-III fire rating, while the densified poplar has a class-II fire rating and the densified alder has a class-III fire rating.

Another important characteristic of the densified wood products is that they absorbed 40–50% less water during a 2 hour soak period than did the high quality natural hardwoods.

The strength properties of static bending and compressive strength for the densified wood products were approximately equal in most cases and in some cases were superior to the high quality natural hardwood. Abrasion tests indicated that the densified poplar wore down 3 times less than oak, while the densified alder wore down 1½ times less than oak, during the same period of time.

The densified wood products also showed excellent glueability and very good resistance to fungus.

I claim:

1. A process for densifying solid wood which comprises the steps of:

(a) impregnating a high moisture containing solid wood member with anhydrous ammonia whereby the wood member is plasticized to a sponge-like form saturated with water and ammonia, (b) placing the plasticized wood member beteen perforated press plates of a cyclic press and, while maintaining the temperature of the plasticized wood member below 100° C., subjecting it to a plurality of compression cycles with the entire wood member being substantially simultaneously compressed to a predetermined thickness, held at that thickness for a short period of time and released during each cycle, whereby water and ammonia are squeezed out of the wood member through the faces thereof down to a moisture content of less than 30% to obtain a damp wood member of predetermined reduced thickness, (c) transferring the damp wood member of reduced thickness to a drying chamber, and (d) drying the damp compressed wood member to obtain a dry, permanently densified solid wood product.

2. A process according to claim 1 wherein the solid wood is a low density, low quality wood.

3. A process according to claim 2 wherein the solid wood is a low density, low quality hardwood.

4. A process according to claim 3 wherein the hardwood is green.

5. A process according to claim 4 wherein the green hardwood contains at least about 80% moisture.

6. A process according to claim 4 wherein the wood is selected from poplar, alder, cottonwood, rubber tree and soft maple.

7. A process according to claim 6 wherein the wood is a sapwood.

8. A process according to claim 2 wherein the wood contains at least about 50% moisture.

9. A process according to claim 8 wherein the solid wood is in the form of a plank having a thickness of up to two inches.

10. A process according to claim 8 wherein the solid wood is in the form of a thin veneer sheet.

11. A process according to claim 8 wherein the solid wood is in the form of a pre-glued laminate.

12. A process according to claim 2 wherein the solid wood member is impregnated with ammonia by firstly evacuating the wood member under vacuum while contacting the wood member with ammonia gas and secondly treating the evacuated wood member with ammonia gas at a super-atmospheric pressure.

13. A process according to claim 12 wherein the treatment with ammonia gas is conducted at a pressure of about 100–150 psi for about 2–8 hours.

14. A process according to claim 12 wherein the cyclic pressing is conducted for a total duration of up to about 5 minutes, with each cycle having a duration of about ½ to 1 minute.

15. A process according to claim 12 wherein the cyclic pressing is conducted at a press pressure of up to 175 psi.

16. A process according to claim 15 wherein the wood member is subjected to vibration during the cyclic pressing.

17. A process according to claim 1 wherein the wood is compressed to a thickness of up to 50% less than its original thickness.

18. A process according to claim 1 wherein the final drying is conducted at a temperature below 100° C., with the compressed wood member being firmly held between plates during drying to prevent warping.

19. A process according to claim 18 wherein the moisture content is reduced to about 8% during final drying.

* * * * *